United States Patent [19]

Russell et al.

[11] Patent Number: 4,647,184

[45] Date of Patent: Mar. 3, 1987

[54] AUTOMATIC SETUP APPARATUS FOR AN ELECTROPHOTOGRAPHIC PRINTING MACHINE

[75] Inventors: James P. Russell, Ontario; Ralph G. Faull, Macedon; Wayne A. Buchar, Rochester, all of N.Y.

[73] Assignee: Xerox Corporation, Stamford, Conn.

[21] Appl. No.: 798,369

[22] Filed: Nov. 18, 1985

Related U.S. Application Data

[63] Continuation of Ser. No. 713,371, Mar. 18, 1985, abandoned.

[51] Int. Cl.[4] ..... G03G 15/00

[52] U.S. Cl. ..... 355/14 C; 355/14 CH; 355/14 D; 355/14 E

[58] Field of Search ..... 355/14 R, 14 E, 14 CH, 355/14 C, 3 R, 3 CH, 14 D

[56] References Cited

U.S. PATENT DOCUMENTS

| | | | |
|---|---|---|---|
| 3,788,739 | 1/1974 | Coriale | 355/14 E |
| 3,981,268 | 9/1976 | Tsukamoto et al. | 355/14 D X |
| 4,105,321 | 8/1978 | Urso | 355/3 CH |
| 4,178,095 | 12/1979 | Champion et al. | 355/14 R |
| 4,239,374 | 12/1980 | Tatsumi et al. | 355/14 E |
| 4,248,524 | 2/1981 | Takahashi | 355/14 E |
| 4,306,804 | 12/1981 | Sakamoto et al. | 355/14 E |
| 4,310,237 | 1/1982 | Gengelbach | 355/14 E |
| 4,313,671 | 2/1982 | Kuru | 355/14 D |
| 4,318,610 | 3/1982 | Grace | 355/14 D |
| 4,348,099 | 9/1982 | Fantozzi | 355/14 E |
| 4,350,435 | 9/1982 | Fiske et al. | 355/14 C |
| 4,377,338 | 3/1983 | Ernst | 355/14 D |
| 4,533,234 | 8/1985 | Watai et al. | 355/14 D |
| 4,536,082 | 8/1985 | Motohashi et al. | 355/14 E X |

OTHER PUBLICATIONS

Article entitled "Automated Setup for Xerographic Copiers", by Robert L. Thompson, *Xerox Disclosure Journal*, vol. 9, No. 3, May/Jun. 1984, p. 179.

*Primary Examiner*—A. C. Prescott

[57] ABSTRACT

An automated process and apparatus is provided for establishing the basic xerographic operating parameters for an electrophotographic printing machine. The document scanning means is used in a setup mode to generate test patches of varying density on the machine photoreceptor. The levels are measured and compared to present values stored in a digital controller memory until convergence is obtained along three separate points on the PIDC curve. The controller adjusts the system parameters of charge circuit, developer bias and system exposure in an iterative process and corresponding to the photo-induced discharge curve for the particular machine.

9 Claims, 12 Drawing Figures

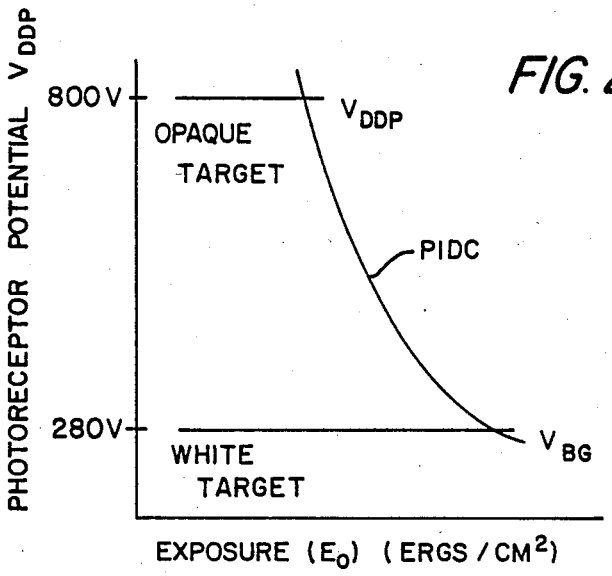
FIG. 2
FIG. 5
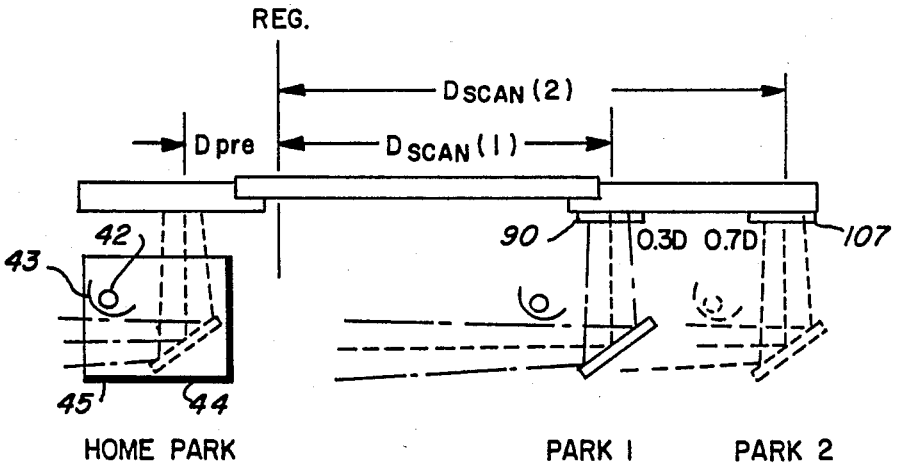

AUTOMATIC SETUP APPARATUS FOR AN ELECTROPHOTOGRAPHIC PRINTING MACHINE

This is a continuation of application Ser. No. 713,371, filed Mar. 18, 1985, now abandoned.

This invention relates to electrophotographic printing machines and, more particularly, to a completely automated apparatus for establishing basic xerographic parameters at values previously determined to produce optimum output copy quality.

In electrophotographic devices, such as a xerographic copier or printer, a photoconductive surface is charged to a substantially uniform potential. The charged portion of the photoconductive surface is exposed to a light image of an original document being reproduced, forming an electrostatic latent image at the photoconductive surface corresponding to the informational areas contained within the original document. The electrostatic latent image is subsequently developed by bringing a developer mixture into contact therewith. The developed image is subsequently transferred to an output copy sheet. The powder image on the output sheet is then heated to permanently affix it to the sheet in the image configuration.

For any given population of electrophotographic printing machines, a primary control objective is to maintain uniform optimum copy quality from machine to machine. This goal has proven difficult to achieve since each machine experiences its own peculiar changes during extended operation. These changes include aging of the developer mixture, changes in environment, variations in the dark development potential, and residual voltage of the photoconductor or photoreceptor surface, a thinning of the photoreceptor surface due to abrasion, photoreceptor fatigue, exposure lamp illumination variations, and changes in the toner material concentration due to consumption. These variations, singly or cumulatively, have adverse affects on output copy quality that must be identified and compensated for on a continuous basis.

Various control schemes are known to compensate for the variable factors listed above. These schemes involve adjustment of basic control parameters; viz. adjusting the current of the device used to deposit the charge on the photoconductive surface, adjusting the bias applied to the development unit varying the concentration of the toner mixture and changing the exposure level. All of these adjustments are interrelated and their proper selection by a machine operator during operation, or a technician during initial setup, have proven difficult and expensive to achieve, as well as time consuming. Generally, also, some kind of test density target, either a special document, or an articulated device is necessary to calibrate exposure levels.

It would be desirable, therefore, to provide a control apparatus that adjusts for these various functions in a manner that is automated so as to reduce the potential for human error. It would be desirable to perform these adjustments within a relatively short period of time, using an apparatus that is wholly self-contained, e.g. does not require the use of portable current and voltage measuring devices.

In accordance with the present invention, there is provided an apparatus for automatically adjusting basic xerographic parameters in a periodic initialization mode so as to establish predetermined copy quality and density. This apparatus includes optical means for forming at least four varying density patches on a precharged photoconductive surface, means for sensing the charged levels at three of said density patches, control means having stored therein a set of interrelated electrical values which define a predetermined photo-induced discharge curve (PIDC), said control means adapted to evaluate said sensed charge levels and determine whether they establish convergence with the desired PIDC and, through an iterative process, to vary charge current and exposure levels, until such convergence is realized and means responsive to the density of toner particles deposited on a fourth density patch for controlling the concentration of toner particles in the developer mixture.

More particularly, the invention relates to apparatus for optimizing the operation of an electrophotographic printing machine having a corona device for applying a charge to the machine photoreceptor, a scan-illumination optical system for illuminating a document to be copied on a platen surface and for projecting an image of the document along an optical path onto the photoreceptor to form a latent image thereof, a developer unit for applying toner to the belt surface, said apparatus further comprising, in combination:

a digital controller, memory means within said controller, having stored therein a digital representation of the photo-induced discharge curve (PIDC) for the machine photoreceptor, optical test patch generation means comprising part of said scan-illumination system, said patch generation means adapted to form at least a dark development $V_{DDP}$ patch, a second, full illumination $V_{BG}$ patch and a third intermediate development path on said photoreceptor, a voltmeter for sensing photoreceptor voltage at said test patch areas and for sending representative signals to said memory means, first logic means within said controller for analyzing the voltmeter input signals representing the values $V_{DDP}$ and $V_{BG}$ levels, comparing the difference (constant contrast voltage $V_C$), between these signals and a preset optimum value of $V_C$ stored within the memory means and selectively regulating the corona device and the developer unit in an iterative process until convergence is obtained between said difference and said preset value, said logic means further adapted to analyze the voltmeter input signals representing said intermediate development patch, comparing said signal with a preset optimum value stored within the memory means and selectively regulating the illumination output level of said scan-illumination optical system in an iterative process until convergence is obtained between said measured and stored values.

Other aspects of the present invention will become apparent as the following description proceeds and upon reference to the drawings in which:

FIG. 2 shows PIDC plot of Exposure vs. Photoreceptor Potential;

Figure 4A:
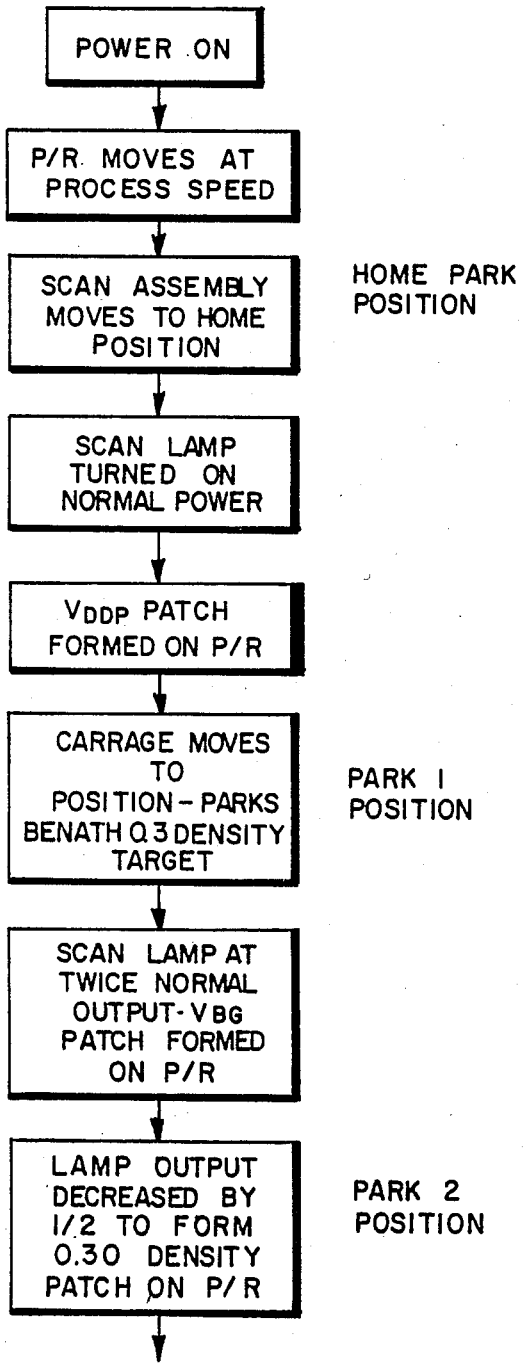
Figure 4B:
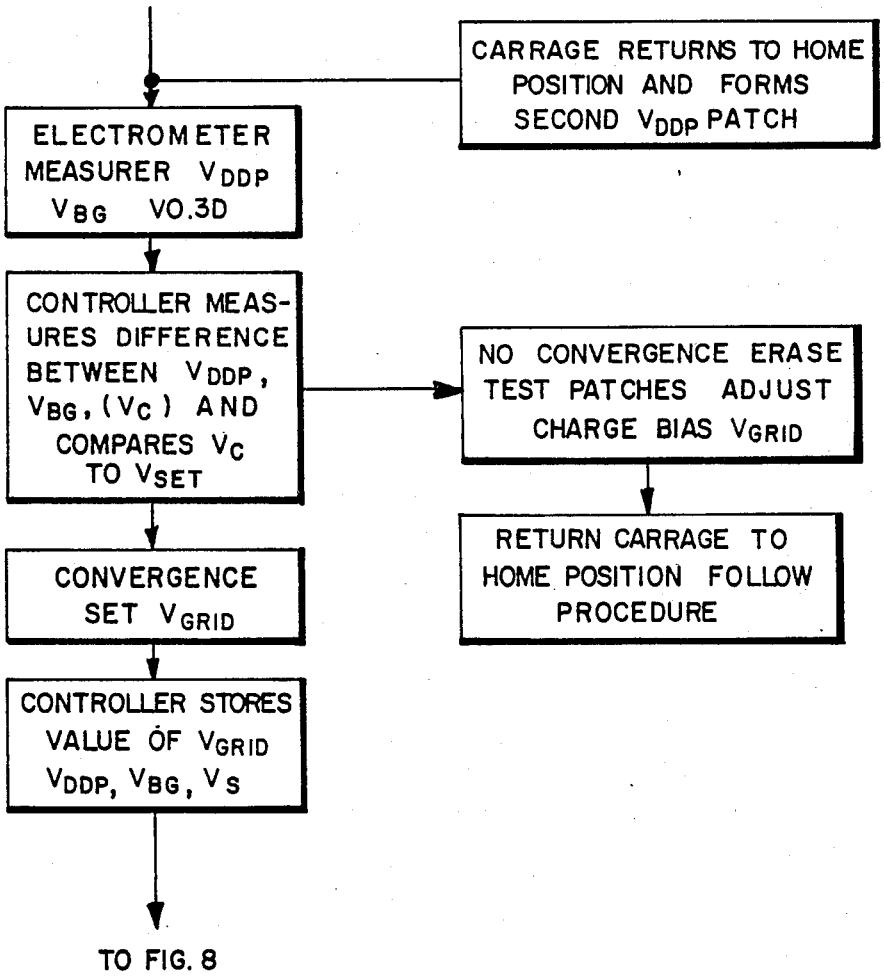
Figure 6:
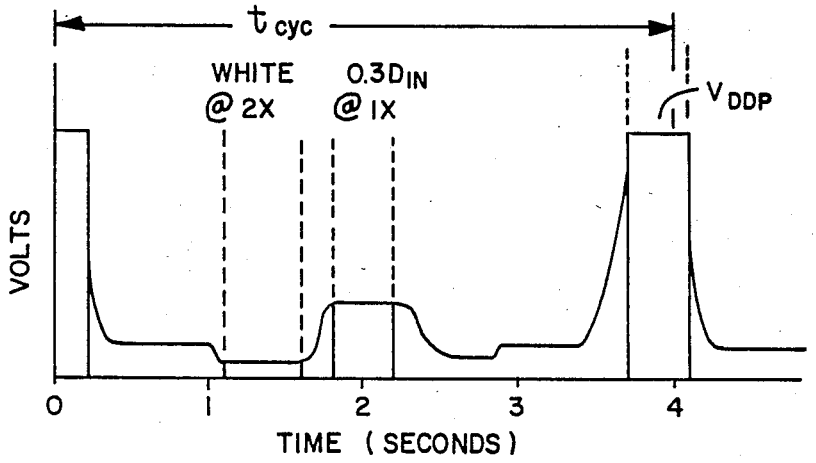
Figure 10:
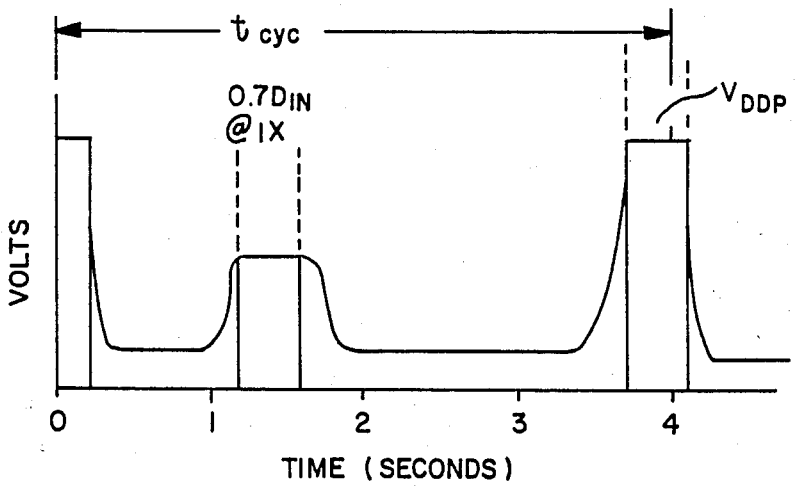
Figure 7:
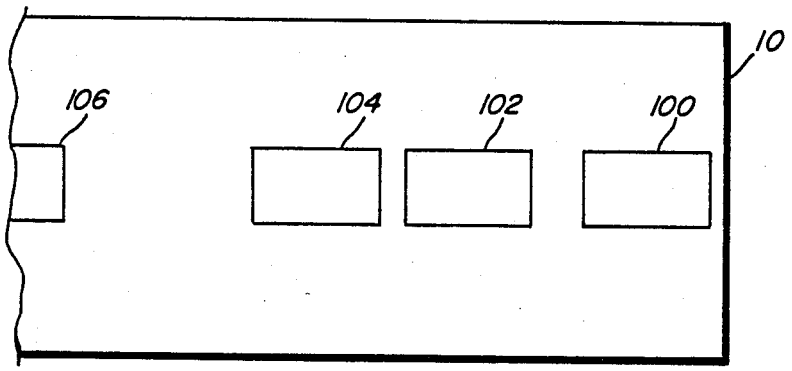
Figure 11:
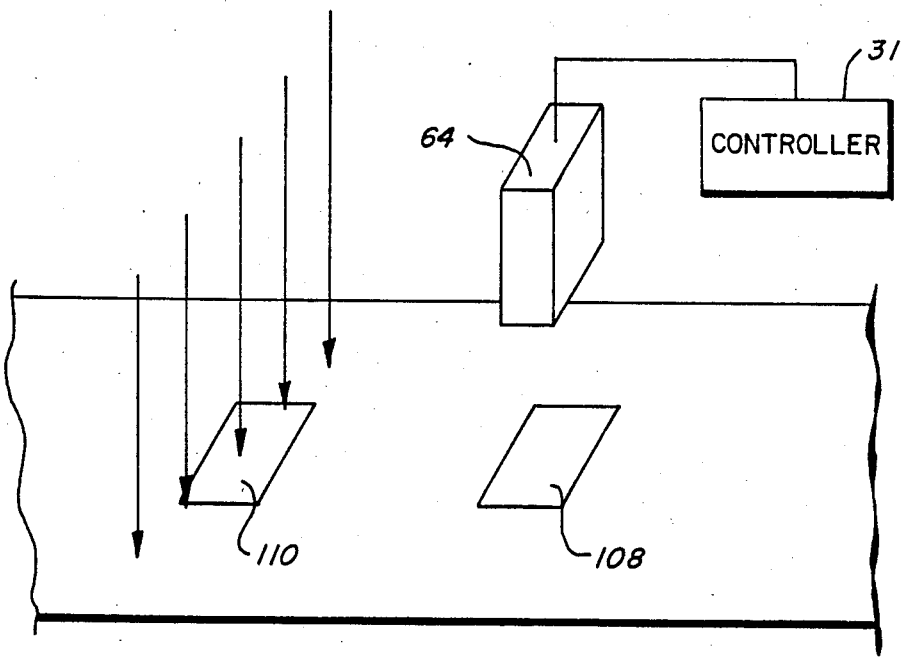
Figure 8:
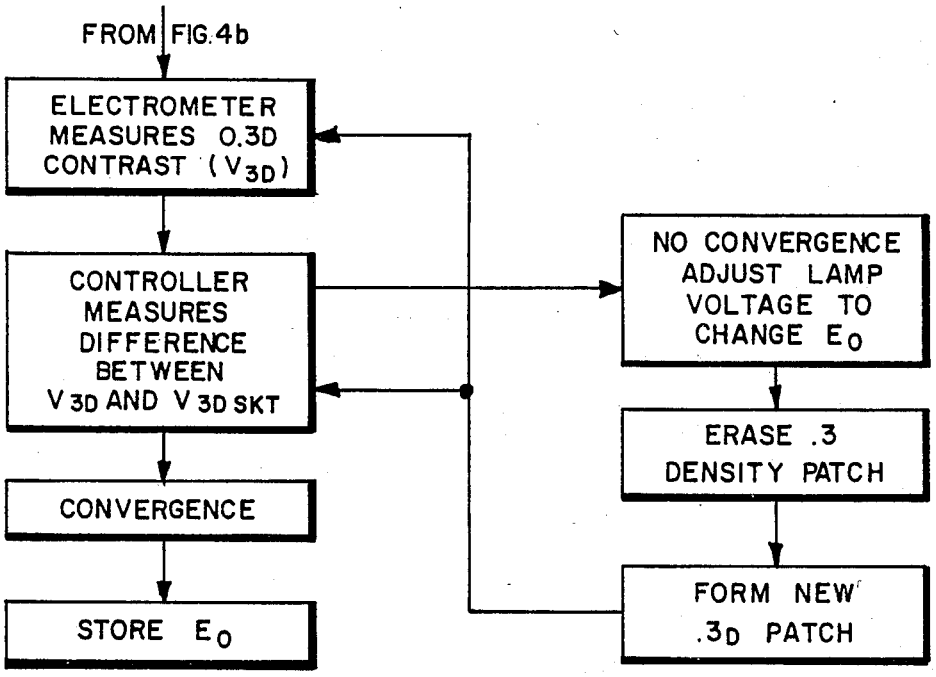
Figure 9:
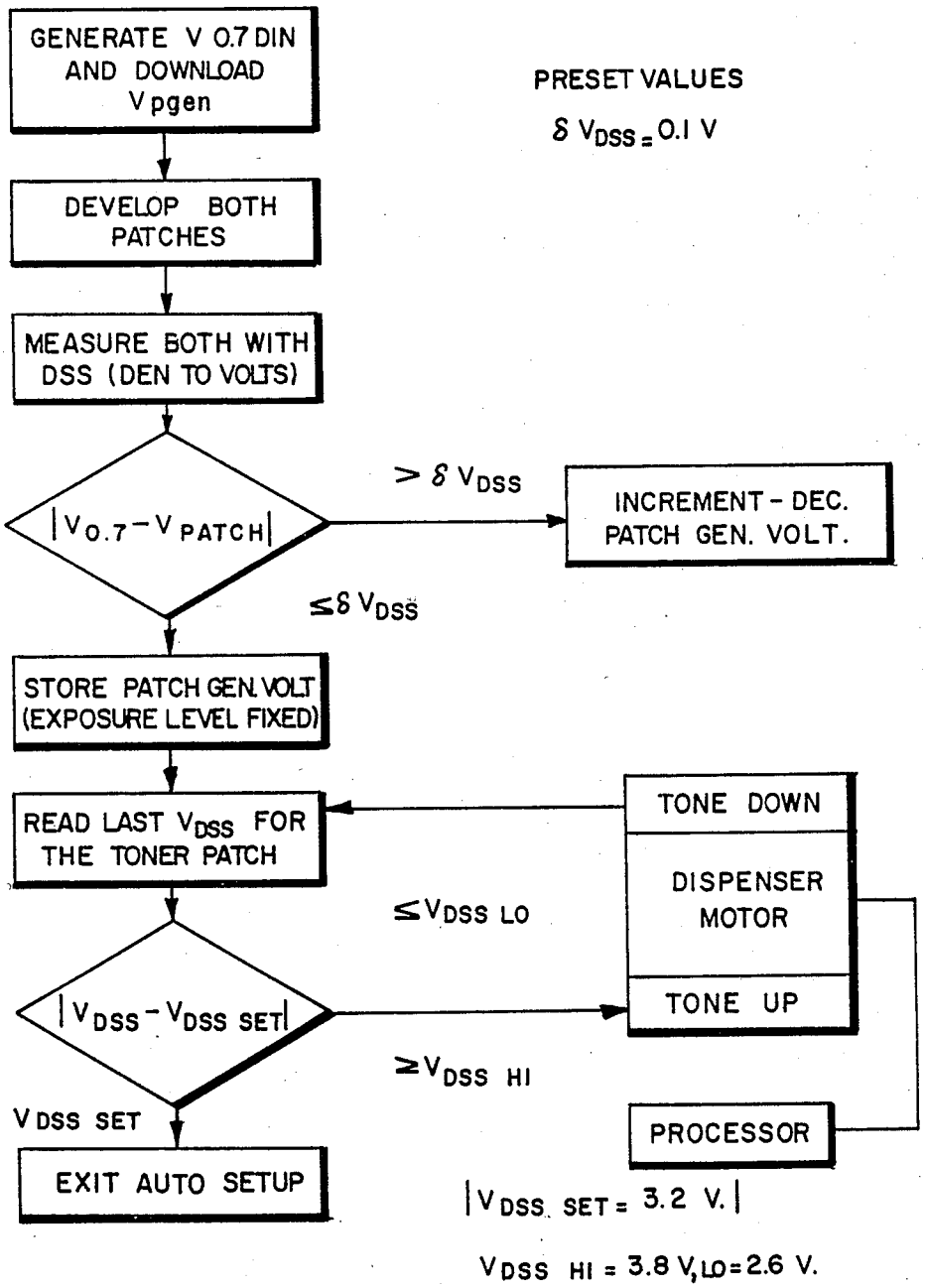

FIGS. 4*a*, 4*b* is a functional flow diagram of the patch generation portion of the automatic setup procedure;

FIG. 5 is a side schematic view of the scan carriage at separate density generating positions;

FIG. 6 is a time vs. voltage plot of the test patch generation sequence;

FIG. 7 is a top view of a portion of the photoreceptor belt having test patches formed thereon;

FIG. 8 is a functional flow diagram of the 0.3D density patch generation;

FIG. 9 is a functional flow diagram showing the exposure convergence sequence;

FIG. 10 is a time vs. voltage plot of the 0.7 density test patch generation;

FIG. 11 is a top view of a portion of the photoreceptor but having 0.7 density patch formed thereon.

Figure 1:
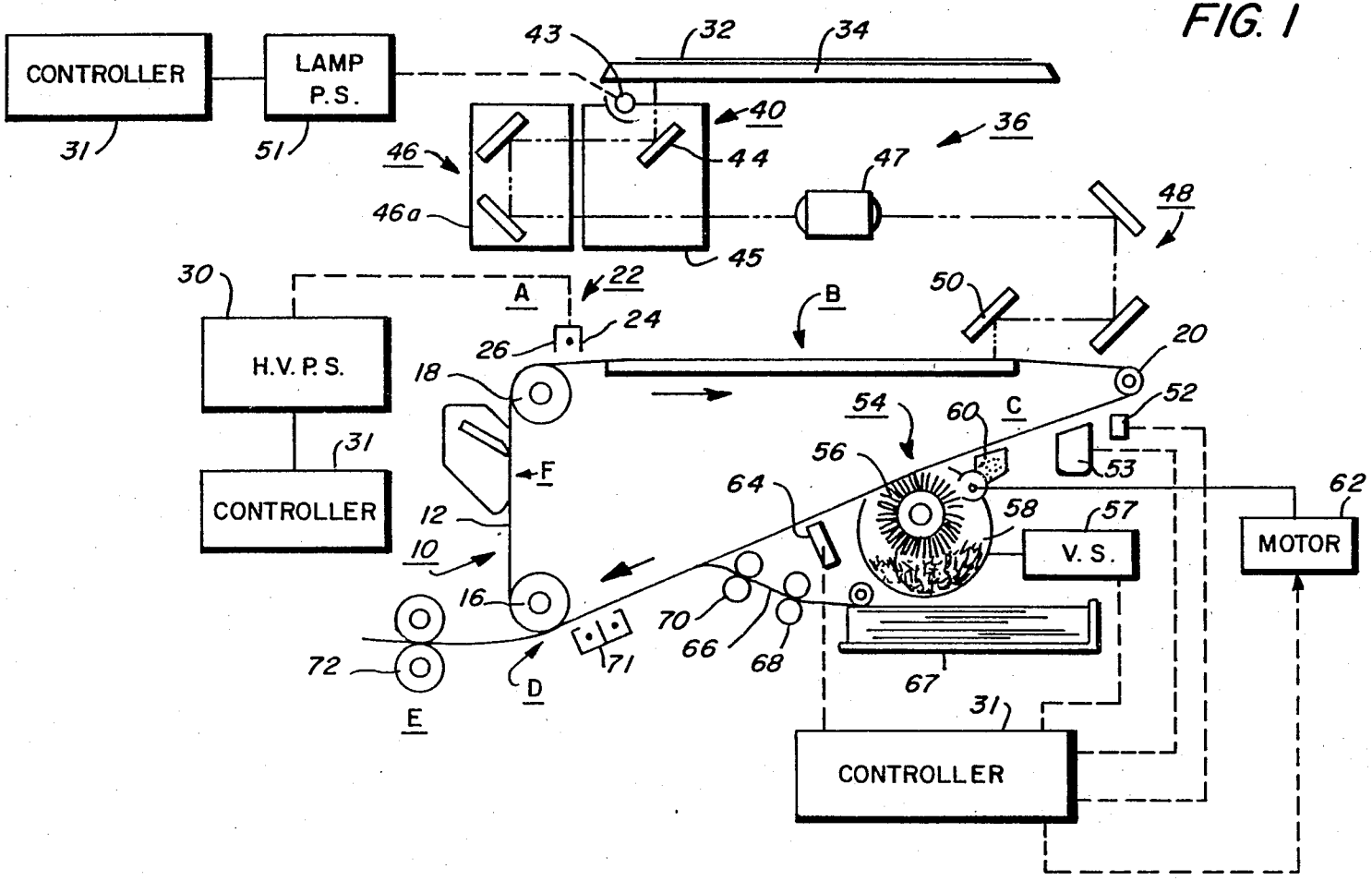
FIG. 1 is a side schematic view of an electrophotographic printing machine incorporating the features of the present invention.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the control system of the present invention therein. It will become apparent from the following discussion that this control system is equally well suited for use in a wide variety of electrophotographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine uses a photoreceptor belt 10 having a photoconductive surface 12 formed on a conductive substrate. Preferably, belt 12 has characteristics disclosed in U.S. Pat. No. 4,265,990 whose contents are hereby incorporated by reference. Belt 10 moves in the indicated direction, advancing squentially through the various xerographic process stations. The belt is entrained about drive roller 16 and tension rollers 18, 20. Roller 16 is driven by conventional motor means, not shown.

With continued reference to FIG. 1, a portion of belt 10 passes through charging station A where a corona generating device, indicated generally by the reference numeral 22, charges photoconductive surface 12 to a relatively high, substantially uniform, negative potential. Device 22 comprises a charging electrode 24 and a conductive shield 26. A high voltage supply 30 controlled by a portion of controller 31, is connected to shield 26. A change in the output of power supply 30 causes a change in charging current, $I_C$, and consequently, a change in the charge potential applied to surface 12.

As belt 10 continues to advance, the charged portion of surface 12 moves into exposure station B. An original document 32 is positioned, either manually, or by a document feeder mechanism (not shown) on the surface of a transparent platen 34. Optics assembly 36 contains the optical components which incrementally scan-illuminate the document and project a reflected image onto surface 12 of belt 10. Shown schematically, these optical components comprise an illumination scan assembly 40, comprising illumination lamp 42, associated reflector 43 and full rate scan mirror 44, all three components mounted on a scan carriage 45. The carriage ends are adapted to ride along guide rails (not shown) so as to travel along a path parallel to and beneath, the platen. Lamp 42 illuminates an incremental line portion of document 32. The reflected image is reflected by scan mirror 44 to corner mirror assembly 46 on a second scan carriage 46A moving at ½ the rate of mirror 44. The document image is projected through lens 47 and reflected by a second corner mirror 48 and belt mirror 50, both moving at a predetermined relationship so as to precess the projected image, while maintaining the required rear conjugate onto surface 12 to form thereon an electrostatic latent image corresponding to the informational areas contained within original document 32. Adjustable illumination power supply 51, controlled by a portion of controller 31, supplies power to lamp 42. The optics assembly 36, besides operating in a document scanning mode, is also used in the automatic setup mode of the present invention, to generate and project four alternating density patches onto the centerline of the belt 10 for purposes to be described more fully below. Positioned between exposure station B and development station C, and adjacent to surface 12, is electrostatic voltmeter 52. Voltmeter 52 preferably is capable of measuring either positive or negative potentials and utilizes ac circuitry requiring no field calibration. Voltmeter 52, in the automatic setup mode, generates a first signal proportional to the dark decay potential $V_O$ on photoconductive surface 12. The dark development potential is the charge at surface 12 after charging and exposure reflected from an opaque object. The voltmeter also generates a second signal proportional to background potential $V_B$, on the photoreceptor surface. The background potential is the charge on the photoreceptor after exposure with light reflected from a white object. Both of the voltmeter output signals are sent to controller 31 through suitable conversion circuitry. Controller 31 operates upon these values, comparing them to values related to a desired output quantity in the controller memory. Adjustments are made by the controller to the charging and development bias voltage and to the illumination power supply in an interative process described in further detail below:

Referring again to FIG. 1, discrete patch generator 53 is a calibrated LED light source which is energized in one of two modes of operation. In a first mode, operable during the automatic setup mode, a dedicated digital input provides for LED energization at a high fixed level. This mode is used primarily for erasing test patch areas generated during the setup procedures. In a second mode of operation, following the initial system setup, an analog reference input to the generator 53 provides for energization of the LEDs so as to generate a variable light intensity for use in toner control in several contrast modes as described in greater detail below.

At development station C, a magnetic brush development system, indicated generally by the reference numeral 54, advances an insulating development material into contact with the electrostatic latent image. Preferably, magnetic brush development system 54 includes a developer roller 56 within a housing 58. Roller 56 transports a brush of developer material comprising magnetic carrier granules and toner particles into contact with belt 10. Roller 56 is positioned so that the brush of developer material deforms belt 10 in an arc with the belt conforming, at least partially, to the configuration of the developer material. The thickness of the layer of developer material adhering to developer roller 56 is adjustable. Roller 56 is biased by voltage source 57 to a voltage level $V_D$.

The electrostatic latent image attracts the toner particles from the carrier granules forming a toner powder image on photoconductive surface 12. The detailed structure of the magnetic brush development system is more fully disclosed in U.S. Pat. No. 4,397,264, whose contents are hereby incorporated by reference.

As successive latent images are developed, toner particles are depleted from the developer material. A toner particle dispenser, indicated generally by the reference numeral 60 provides additional toner particles to housing 58 for subsequent use by developer roller 56. Toner dispenser 60 includes a container for storing a supply of toner particles therein and means (not shown) for introducing the particles into developer housing 58. A motor 62, when energized, initiates the operation of dispenser 60.

Infrared densitometer 64, positioned adjacent belt 10 and located between developer station C and transfer station D, directs infrared light onto surface 12 upon appropriate signals from the controller 31. The ratio of reflected light on a developed area to that of a bare area is an idication of toner patch developability. The densitometer generates output signals and sends them to controller 31 through appropriate conversion circuitry. The controller operates upon these signals and sends appropriate output signals to motor 62 to control dispensing of toner particles. Densitometer 64 is also used to periodically measure the light rays reflected from the bare photoconductive surface (i.e. without developed toner particles) to provide a reference level for calculation of the signal ratios.

Continuing with the system description, an output copy sheet 66 taken from a supply tray 67, is moved into contact with the toner powder image at transfer station D. The support material is conveyed to station D by a pair of feed rollers 68, 70. Transfer station D includes a corona generating device 71 which sprays ions onto the backside of sheet 66, thereby attracting the toner powder image from surface 12 to sheet 66. After transfer, the sheet advances to fusing station E where a fusing roller assembly 72 affixes the transferred powder image. After fusing, sheet 66 advances to an output tray (not shown) for subsequent removal by the operator.

After the sheet of support material is separated from belt 10, the residual toner particles and the toner particles of developed test patch areas are removed at cleaning station F.

Subsequent to cleaning, a discharge lamp, not shown, floods surface 12 with light to dissipate any residual charge remaining thereon prior to the charging thereof for the next imaging cycle.

It is believed that the foregoing description is sufficient for purposes of the present application to illustrate the general operation of an electrophotographic printing machine incorporating the features of the present invention therein.

These features may be briefly summarized as:

1. Control of pre-development photoreceptor potentials using voltmeter 52 and associated controller circuitry;
2. Generation of multiple exposure levels (test patches) using the system optics assembly 36; and
3. Control of developed image density by using densitometer 64 to measure the reflectance of developed toner patches.

According to further aspects of the invention, only two of the sensors, the voltmeter and the densitometer, need to maintain an absolute calibration. All major xerographic parameters are automatically established during the automatic setup mode and are automatically maintained thereafter. The setup procedure is reproducible over time within a single machine and from machine to machine across a population of machines.

Automatic Setup Mode

Figure 3:
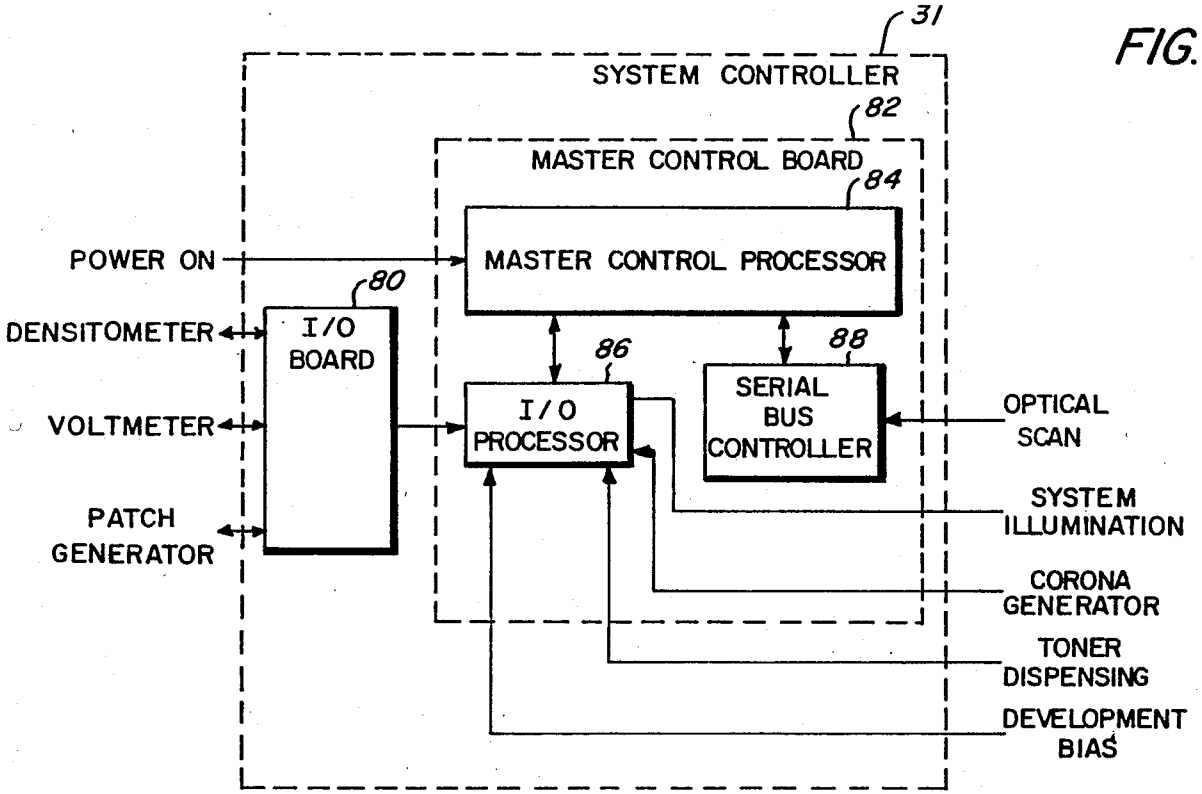
FIG. 3 is a block diagram of the system controller.

Upon initial installation of a particular electrophotographic printing machine and periodically (daily) thereafter, the basic machine parameters are automatically checked and adjusted. Each machine is associated with the same development potentials ($V_I - V_D$) by adjustment of the shape of the photo-induced discharge curve (PIDC) which has previously been determined to ensure uniform output copy quality across the machine population. A PIDC is a fundamental characteristic of a photoreceptor that has been charged to a specific dark potential $V_O$ in combination with the reflective density of the input document and the document illumination intensity. But any given population of photoreceptors will have a distribution of shapes. FIG. 2 shows a typical plot for a machine with the range of values indicated. Digital values representing the PIDC slope are contained within controller 31 memory of each machine. The setup mode and associated apparatus is designed to measure the basic parameters of the particular machine and plot the PIDC, based on these measured values. Insofar as the actual PIDC shape varies from the standard, adjustments are made to the basic parameters of charge voltage $I_C$, developer bias $V_{BIAS}$ and system exposure $E_O$ in an iterative process, until convergence of the measured, with the preset, values is realized. These basic control circuit subsystems which accomplish these operations are shown in FIG. 3. Referring to this Figure, controller 31 consists of Input/Output Board 80, and master control board 82, Input/Output processor 86 and a serial bus controller 88, Input signals from the densitometer 64, voltmeter 52 and patch generator 53 are converted by I/O board 80; sent to I/O process 86 and then to processor 84. Output signals are sent to adjust the corona generator, system illumination, toner dispenser and development bias via processor 86. Operation of the optical scanning system is controlled by processor 84 via controller 88.

The master control processor is an Intel Model 8085 which can be programmed to perform the described iterative functions, using the algorithms set forth in the Appendix. Incorporation of these algorithms into a larger and central unit is a procedure well understood by those skilled in the art.

The automatic setup mode is initiated by applying initial power application to the machine. The sequence of operations occurring thereafter is shown with reference to FIGS. 4*a*, 4*b*.

FIGS. 4*a*, 4*b* is a flow chart sequence of these operations. FIG. 5 is a side view schematic drawing of the scan carriage at different density patch generating positions. FIG. 6 is a time vs. voltage plot of the test patch generation sequence, and FIG. 7 is a top view of belt 10 showing the imaged patch zones. FIG. 9 is a flow chart of the test patch generator and machine functions. Referring to FIGS. 4*a*, 5, and 6, once machine power is turned on, the photoreceptor moves through a first cycle of operation at the system process speed. Scan carriage 45 moves to the home park position. Carriage 45, in this position is shown to the left of the platen in FIG. 5. The components are shown dotted. Scan lamp 42 is energized at the normal lamp power level used during the preceding operational interval. An opaque occluder is positioned in the optical path at a point above the belt 10 surface, thus preventing light from falling on the surface in an area corresponding to the occluder. Thus a first test patch 100 shown formed on the belt centerline in FIG. 7 is therefore at the dark decay charging level $V_{DDP}$. Carriage 45 is then moved to the right, scanning at a constant velocity, until it reaches park position 1 past the end of scan position (shown in solid line in FIG. 5). At this position, a 0.3 density strip 90 centrally overlies the scan carriage. At this point, lamp 42 output is doubled so as to form a second patch area 102 conforming in size to strip 90 representing a 100% transmission, completely discharged strip at background voltage level, $V_{BG}$.

With carriage 45 still in the solid line position shown in FIG. 5, the lamp illumination input is halved. The exposed patch area 104 on belt 10 forms a 0.3 density patch 104 on the photoreceptor. Carriage 45 is then returned to the home position and a second $V_{DDP}$ patch 106 is formed on the center line of belt 10.

Further operation of the carriage is dependent upon whether PIDC convergence is present as determined by comparisons of voltmeter-generated signals processed by the microprocessor 84 and compared to values stored in the microprocessor memory.

Electrostatic voltmeter 52, shown in FIG. 1, is used to directly sense photoreceptor voltage at the test patch areas 100, 102, 104, 106. The voltmeter is positioned approximately 3 mm from the belt surface.

FIG. 4*b* shows the functional flow diagram for the voltmeter readings and the related microprocessor control operation. Referring to this figure, and to FIG. 6, the voltmeter measures each of test patch charge levels on successive belt cycles. Signals representing the voltage at patch 100 ($V_{DDP}$), patch 102 ($V_{BG}$) and patch 104 ($V_{0.3D}$) are sent to the control processor 84 through the associated I/O circuitry and temporarily stored therein. The difference between $V_{DDP}$ and $V_{BG}$ is computed by logic means within the controller and a signal, representing this value and designated constant contrast voltage ($V_C$) is generated. This signal is compared to a preset $V_{CSET}$ ($V_S$). If $V_C \neq V_S$, (no convergence), a signal is generated within the processor and sent to change the bias ($V_{GRID}$) on the charge electrode 24 (FIG. 1) thereby changing the value of charge current $I_C$ and the value of $V_{DDP}$. Signals are also sent to patch generator 53 to erase the previously generated patch areas. Scan carriage 45 then repeats the sequence described with respect to FIGS. 4*a* and 5, beginning at the home park position and continuing to park position 2. The newly formed patches are again read by the voltmeter and compared by processor 84 (FIG. 4*b*). This process is an iterative one governed by a control algorithm set forth in the Appendix; the process is continued until the measured value of $V_C$ conforms to $V_S$. At this point, the value of $V_{DDP}$ and $V_{BG}$ conforms to the PIDC for the machine. These values, as well as $V_S$, $V_D$ and $V_{BIAS}$ are stored in the processor memory.

According to one feature of the present invention, a second iterative process is controlled by logic means within processor 84, which compares the measured values of the $V_{0.30}$ patch to a preset $V_{0.3DS}$ value. System illumination is varied to achieve identity of the set and measured values; convergence establishes a third point on the PIDC. As shown in FIG. 8, processor 84 measures the difference between the test value of $V_{3D}$ and the $V_{0.3DS}$, set into the processor memory. If $V_{0.30} \neq V_{0.3DS}$ (no convergence) processor 84 sends a signal to lamp power supply 51 to vary the output of lamp 42 and to patch generator 53 to erase the $V_{0.3D}$ patch 104. Scan carriage 45 repeats the process beginning at the home position 1 and the voltmeter again measures the charge at patch 104 sending the output signal to the processor. This iterative process is controlled by a second algorithm provided in the Appendix.

Upon convergence of $V_{0.3D}$ and $V_{0.3DS}$, the value of $E_O$, system exposure level, is stored. Convergence has assured that the 0.3D voltage also falls on the PIDC curve shown in FIG. 2. Thus, the charge at the high ($V_{DDP}$), low ($V_{BG}$) and intermittent levels all lie along the predetermined PIDC, thus ensuring that the copy quality will be consistent with machine population utilizing that particular PIDC.

To summarize the automatic setup procedure to this point, the basic xerographic parameters of charge current, illumination level and the developer bias have been set. The remainder of the setup procedure is directed to the calibration of the patch generator based on these values and the adjustment, if necessary, of toner concentration. FIG. 9 shows a functional flow diagram setting forth these steps.

Referring to FIGS. 5 and 9, and to the timing diagram showing in FIG. 10, scan carriage 45 is moved to the right, past park position 1 to park position 2 where it is parked directly beneath a centrally located 0.7 density target strip 107. A 0.7 patch 108 (FIG. 1) is thus formed along the centerline of belt 10 conforming in area to strip 107. The carriage then returns to the home position where a $V_{DDP}$ patch 110 is formed. As patch 110 passes beneath patch generator 64, the patch is illuminated by a light output from the generator determined by the bias voltage $V_{PG}$ applied to the patch generator. The charge level at patch 110 is therefore reduced to level $V_{DPG}$ which is lower than $V_{0.7D}$.

Both patches 108 and 110 are developed at development station C (FIG. 1) and pass beneath densitometer 64. As illustrated in FIG. 1 and FIG. 11, the densitometer detects the density of the developed test area and produces electrical output signals indicative thereof. Thus the densitometer produces output signals proportional to the toner mass deposited on the $V_{0.7D}$ patch 108 and the $V_{DPG}$ patch 110. These signals are conveyed to processor 84 through conversion circuitry shown in FIG. 3. Processor 83 compares the two values and if there is a difference ($V_{DSS}$) a signal is generated which changes the voltage level at the patch generator. The developed patches are cleaned at cleaning station F, FIG. 1, and patches 108 and 110 are laid down as previously described, developed and again measured by densitometer 64. Adjustments are made to patch generator 53 in an iterative process governed by the algorithm set forth in the Appendix until the two measured values are equal. When this occurs, the patch generator is properly calibrated to the system parameters and value representing $V_{PG}$ is stored.

The final task of the setup procedure is to adjust the developer parameters, if necessary. An adjustment may not be necessary since the toner concentration level is monitored during normal operation and toner periodically added, as is known in the art. Therefore, a previous operation cycle should have left the toner concentration in a proper operating condition. However, the present setup procedure ensures proper toner concentrations by comparing the last $V_{DDS}$ value measured and stored by processor 84 with a previously stored $V_{DSS}$ value representing a value of $V_{DSS}$ which if exceeded, indicates a low level of toner concentration is present. As shown in FIG. 9, if the difference between the two exceeds a set value, processor 84 activates toner dispenser motor 63 causing toner dispenser 60 to discharge toner particles into toner container 62. This increases the concentration of toner particles in the developer mixture so as to increase the density of subsequent developed test patches. Carriage 45 forms a subsequent $V_{0.7}$, $V_{DDP}$ patch. Densitometer 64 measures the respective density and processor 82 determines a new $V_{DSS}$ value as described above. The new $V_{DSS}$ is compared with the $V_{DSS}$ set, the process repeated, if necessary. Once the values are within the predefined difference range, toner developability parameters have been defined and the automatic setup procedure is terminated. Normal machine operation then begins.

APPENDIX

Controller Algorithms (#1) The grid bias control voltage adjustment for contrast setup is as follows:

$$v_{grid}(n+1)=v_{grid}(n)+\{\{0.C(v_{cntrstset}-v_{cntrst})\}\}$$

(#2) The grid bias additive adjustments for the Pictorial Copy modes ($P_{mode}$) are determined as follows:

$$v_{grid}add(P_{mode})=\{k_1(f_{ddp}(P_{mode}))\}$$

(#3) The $V_{ddp}$ setpoint for the pictorial modes is as follows:

$$v_{ddp}(P_{mode})=v_{ddpsu}+f_{ddp}(P_{mode})$$

Where $f_{ddp}$ for the above two algorithms is:

$$f_{ddp}(P_{mode})=\left\{\frac{F_{ddp}\,P_{mode}}{A_{esv}}\right\}$$

Where $A_{esv}$ is the digital resolution of the ESV input.

(#4) The following equation for developer bias can be used for determining the required bias during ABS (autosetup and customer access mode) as well as for deteremining $V_{biassu}$:

$$V_{bias}=v_{bg}+vbias_{clnfld}$$

The term $v_{bg}$ is replaced with $v_{absmin}$ during any ABS adjustment and replaced with $v_{P11}$ during the $V_{biassu}$ calculation.

The term $vbias_{clnfld}$ is the cleaning field in terms of developer bias. There is a value for each of the normal copy modes. During setup the value is for CN.

$$vbias_{clnfld}(\text{Mode})=\left\{\frac{F_{clean}(\text{Mode})}{G_{db}}\right\}$$

The particular mode is found in the Table "Multinational Standard Modes" at the end of the Appendix.

(#5) The illumination control voltage adjustment for the exposure setup is expressed in terms of bit count as follows:

$$E_O(n+1)=E_O(n)+\{\{k_2(v_{0.3cont}-c_{0.3contset})\}\}$$

(#6) The pre-developability patch generator adjustment is as follows:

$$v_{pgen}=v_{pgen}+(k_3\Delta v_{ddp}-\Delta v_{bias})$$

(#7) For the patch generator setup, if the error in the DSS readings is greater than 3 bits and the number of iterations is less than 3 (cycles is less than 7), the correction applied is:

$$v_{pgen}(n+1)=v_{pgen}(n)+\{k_4(dss_{p21}(ave)=dss_{PO}(n)\}$$

(#8) The final adjustment to the patch generator level is as follows:

$$V_{pgen}(n+1)=V_{pgen}(n)+\{k_4(v_{0.7average}-(v_{bg}+v_{clnfld})-v_{0.7devset})\}$$

(#9) The developer bias setpoint for the copy modes is as follows:

$$v_{bias}(Mode)=v_{biassu}+f_{bias}(Mode)$$

Where $f_{bias}$ is:

$$f_{bias}(\text{Mode})=\left\{\frac{F_{bias}(\text{Mode})}{G_{db}}\right\}$$

Multinational Standard Modes

| Mode | $F_{exp}$ | $F_{bias}$ (v) | $F_{ddp}$ (v) | $F_{pgen}$ | $F_{clean}$ (v) |
|---|---|---|---|---|---|
| CL4 | 1.4 | +45 | 0 | 0.76 | +160 |
| CL3 | 1.4 | +10 | 0 | 0.95 | +125 |
| CL2 | 1.29 | 0 | 0 | 1.0 | +105 |
| CL1 | 1.14 | 0 | 0 | 1.0 | +90 |
| CN | 1.00 | 0 | 0 | 1.0 | +65 |
| CD1 | 0.89 | 0 | 0 | 1.0 | +50 |
| CD2 | 0.79 | 0 | 0 | 1.0 | +20 |
| CD3 | 0.75 | −10 | 0 | 1.06 | −5 |
| CD4 | 0.75 | −45 | 0 | 1.25 | −40 |

Pictoral Modes

| Mode | $F_{exp}$ | $F_{bias}$ | $F_{ddp}$ | $F_{pgen}$ | $F_{clean}$ |
|---|---|---|---|---|---|
| PL4 | 1.32 | −135 | −345 | 0.00 | +30 |
| PL3 | 0.93 | −150 | −360 | 0.00 | +5 |
| PL2 | 0.79 | −125 | −335 | 0.00 | +10 |
| PL1 | 0.71 | −95 | −295 | 0.03 | +25 |
| PN | 0.71 | −80 | −245 | 0.20 | +25 |
| PD1 | 0.71 | −65 | −190 | 0.40 | +15 |
| PD2 | 0.85 | −65 | −145 | 0.63 | +25 |
| PD3 | 1.00 | −65 | −100 | 0.86 | +40 |
| PD4 | 0.99 | −65 | −55 | 1.08 | +25 |

What is claimed is:

1. Apparatus for optimizing the operation of an electrophotographic printing machine, said apparatus including a corona device for applying a charge to the machine photoreceptor, a scan-illumination optical system for illuminating a document to be copied on a platen surface a projection lens for projecting a reflected image of the document along an optical path onto the photoreceptor to form a latent image thereof, a developer unit for applying toner to the belt surface, said apparatus further including in combination:

a digital controller, memory means within said controller, having stored therein a digital representation of the photo-induced discharge curve (PIDC) for the machine photoreceptor, optical test patch generation means comprising part of said scan-illumination system, said patch generation means adapted to form at least a dark development $V_{DDP}$ patch, a second, full illumination $V_{BG}$ patch and a third intermediate development patch on said photoreceptor, a voltmeter for sensing photoreceptor voltage at said test patch areas and for sending representative signals to said memory means, first logic means within said controller for analyzing the voltmeter input signals representing the values $V_{DDP}$ and $V_{BG}$ levels, comparing the difference (constant contrast voltage $V_C$), between these signals and a preset optimum value of $V_C$ stored within the memory means and selectively regulating the corona device and the developer unit in an iterative process until convergence is obtained between said difference and said preset value, said logic means further adapted to analyze the voltmeter input signals representing said intermediate development patch, comparing said signal with a preset optimum value stored within the memory means and selectively regulating the illumination output level of said scan-illumination optical system in an iterative process until convergence is obtained between said measured and stored values.

2. The apparatus of claim 1 further including discrete patch generator erase means positioned adjacent the photoreceptor and adapted to selectively erase said development patches during said iterative process.

3. The apparatus of claim 1 further including a densitometer positioned adjacent the photoreceptor downstream from the development station, and wherein said optical test patch generation means is adapted to produce a second intermediate development patch on said photoreceptor, said logic means further adapted to analyze the voltmeter input representing said second intermediate level and the $V_{DDP}$ level, comparing the difference between these signals, and, if a difference is detected, selectively regulating the discrete patch generator output in an iterative process until the two measured values are equal.

4. The apparatus of claim 1 wherein said optical test patch generation means includes a scan carriage comprising an elongated illumination assembly and a scan mirror, said platen surface having a first opaque occluder affixed to the bottom surface at a first test patch generation position, a second intermediate density occluder affixed to the bottom surface at a second test patch generation position and a third intermediate density occluder affixed to the bottom surface at a third position, said digital controller adapted to vary the output of said illuminator assembly at each of the test patch generation positions.

5. The process of automatically adjusting the basic xerographic parameters of an electrophotographic printing machine evaluating charging current, $I_C$, developer bias $V_{BIAS}$ and system exposure $E_O$, comprising the steps of:

(a) driving the machine document scanning optics in a test patch generation mode to lay down a plurality of test patches of different densities on the machine photoreceptor, including a first test patch representing dark decay potential $V_{DDP}$, a second patch representing background voltage level $V_{BG}$ and a third patch representing an intermediate voltage level $V_{0.30}$, (b) measuring the voltage levels at said test patches and generating signals indicative thereof, (c) analyzing said voltage level signals and comparing preset values representative of values lying along the PIDC curve of the particular photoreceptor, (d) adjusting the machine parameters $I_C$, $V_{BIAS}$, and $E_O$ until these comparison values find convergence with these points on the PIDC curve established for the machine photoreceptor.

6. The process of claim 4 including the step of selectively erasing said test patches using a discrete light source.

7. The process of claim 6 including the additional step of calibrating said discrete light source to the final machine parameters.

8. An electrophotographic printing machine comprising:

charging means for applying charge to a photoreceptor surface, said charging means including means to vary the charge output level, an optical assembly adapted to incrementally scan a document lying in an object plane, said optical assembly including means to vary the illumination output of a scan lamp, a projection lens to project a reflected image of the scanned document along an optical path onto the photoreceptor surface to form a latent image of the document thereon, and developer means for developing the latent image, said developer means including means to vary a bias signal applied to said developer means, said apparatus further including a control means for automatically adjusting the xerographic parameters of charging current $I_c$, developer bias $V_{BIAS}$, and system exposure $E_0$, said control means comprising:

a digital controller, memory means within said controller containing a digital representation of the photo-induced discharge curve (PIDC) for the machine photoreceptor, optical test patch generation means comprising part of said optical assembly, said patch generation means adapted to form at least a dark development $V_{DDP}$ patch, a second full illumination $V_{BG}$ patch and a third intermediate development patch on said photoreceptor, a voltmeter for sensing photoreceptor voltage at said test patches and for sending representative signals thereof to said memory means, and logic means within said controller for analyzing the voltmeters input signals representing the values $V_{DDP}$ and $V_{GB}$ levels, comparing the difference (constant contrast voltage $V_C$) between these signals and a preset optimum value of VC stored within the memory means and sending a signal to said charge level varying means and said developer bias varying means in an iterative process until convergence is obtained between said difference and said preset value.

9. The printing machine of claim 8, said logic means further including means to analyze the voltmeter input signals representing said intermediate development patch, comparing said signal with a preset optimum value stored within the memory means and sending a signal to said scan lamp output varying means to selectively regulate the illumination output of said optical system in an iterative process until convergence is obtained between said measured and stored values.

* * * * *